US005701607A

United States Patent [19]

Kaiser

[11] Patent Number: 5,701,607

[45] Date of Patent: Dec. 30, 1997

[54] OVERLAY FOR CAP BILL OR VISOR

[76] Inventor: Paul Kaiser, 557 Acacia Ave., San Bruno, Calif. 94066

[21] Appl. No.: 639,032

[22] Filed: Apr. 16, 1996

Related U.S. Application Data

[63] Continuation-in-part of Ser. No. 336,505, Nov. 9, 1994, abandoned.

[51] Int. Cl.[6] ..... A42B 1/18

[52] U.S. Cl. ..... 2/209.13; 2/10; 2/46; 2/195.1; 40/329

[58] Field of Search ..... 2/195.1, 209.13, 2/10, 12, 46, 175.1, 175.6, 209.11, 209.12; 40/329; 223/24

[56] References Cited

U.S. PATENT DOCUMENTS

| | | | |
|---|---|---|---|
| 1,610,745 | 12/1926 | Castanaro . | |
| 5,081,717 | 1/1992 | Shedd et al. | 2/199 |
| 5,088,126 | 2/1992 | Mathis | 2/181 |
| 5,161,259 | 11/1992 | Shorts . | |
| 5,197,150 | 3/1993 | Bedient | 2/195 |
| 5,406,645 | 4/1995 | Lin | 2/10 |
| 5,410,761 | 5/1995 | Connelly et al. | 2/195.1 |
| 5,556,135 | 9/1996 | Duncan | 2/209.13 |

*Primary Examiner*—Diana Biefeld

[57] ABSTRACT

An overlay for a cap bill or visor is disclosed. The overlay is constructed of impermeable, flexible material. On the underside of the overlay is an adhesive covered by a protective film. This protective film is removed and the overlay is placed on top of the cap bill, and the adhesive holds the overlay in place.

18 Claims, 3 Drawing Sheets

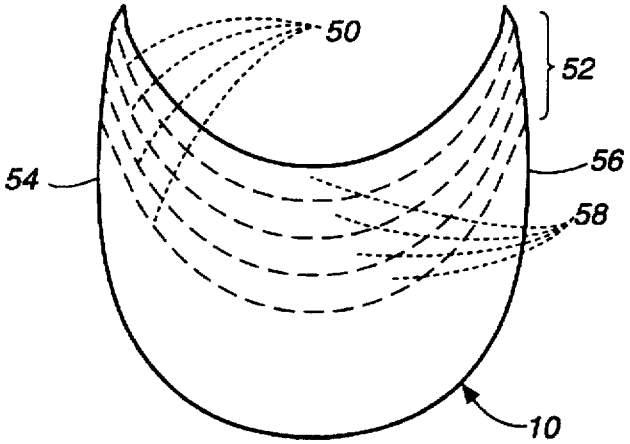
FIG._7
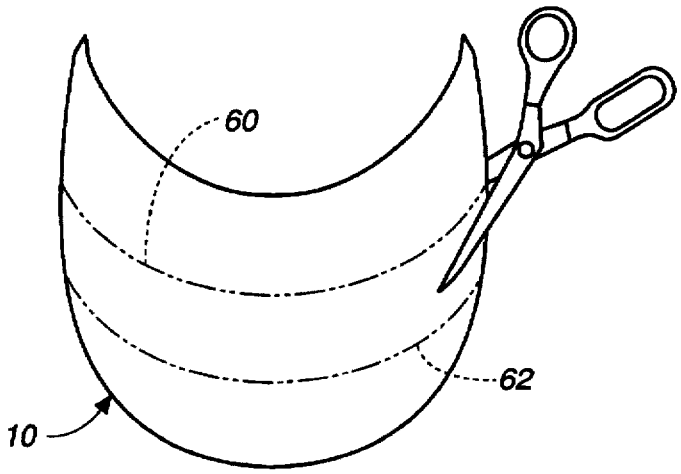
FIG._8
FIG._9
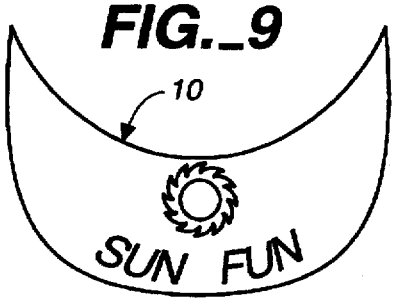
FIG._10
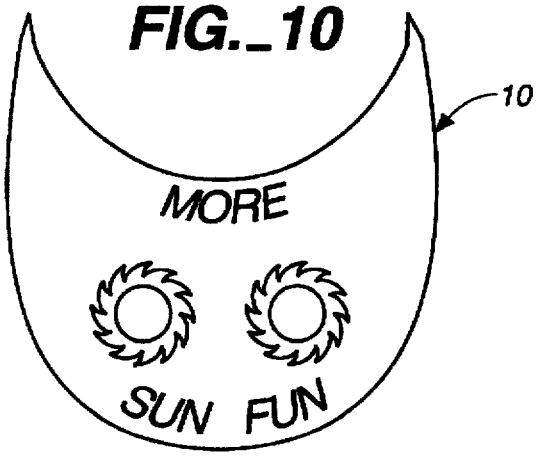

OVERLAY FOR CAP BILL OR VISOR

CROSS-REFERENCE TO RELATED APPLICATIONS

This application is a Continuation-in-Part of prior application Ser. No. 08/336,505 filed Nov. 9, 1994, now abandoned.

One embodiment of this invention uses the design in design application 29/027648, filed Aug. 26, 1994, now abandoned.

BACKGROUND OF THE INVENTION

1. Field of the Invention

This invention relates to baseball caps and sun visors.

2. State of the Art

Baseball style caps are a popular hat style. These caps typically have a semi-spherical shell that fits over the wearer's head, and a brim or bill that extends perpendicularly from the bottom of the shell. Sun visors, which consist of a hard visor and a small, curved frame are also popular.

Cap bills are made of a rigid material covered with fabric. The rigid material is perforated when the fabric is sewn onto it. When water comes in contact with the top of the cap bill the threads draw water to the interior of the bill which can damage the bill, and the water can also be drawn to the underside of the bill and then fall into the face of the cap wearer.

Cap bills provide some sun protection, but most bills leave certain areas of the face and neck inadequately protected. Many people wear baseball style caps with the bill pointed to their back. Worn in this manner the bill provides inadequate protection for the neck and ears.

The headgear attachments in U.S. Pat. No. 5,161,259 to Shorts and U.S. Pat. No. 5,081,717 to Shedd provide some ear and neck protection, but these attachments can only be worn with the bill pointing forward. Also, Shedd requires modifications to a standard baseball style cap before the attachment can be used.

The cap in U.S. Pat. No. 5,197,150 to Bedient and the visor cap in U.S. Pat. No. 1,610,745 to Castanaro provide a means for extending the length of a cap bill, but both require specially constructed caps.

The complex construction of the caps and attachments in Shedd, Bedient and Castanaro increases their expense of manufacturing, their likelihood of malfunction and their unavailability to people of limited income.

Most cap bills are covered with fabrics that are easily soiled. Also, many cap bills are made of dark, nonreflective fabrics which are difficult to see in low light, thereby causing a safety problem.

OBJECTS OF THE INVENTION

It is an object of the present invention to provide an overlay for a cap brim which can be used with no modification to the cap itself.

Another object of the invention is to provide an overlay which can be attached to and removed from the brim easily without the need for hook-and-loop fasteners, elastic bands, strings, or other types of complicated fastening devices.

Another object of the invention is to provide an overlay which can be attached to the brim by means of an adhesive.

Another object of the invention is to provide an overlay which extends beyond the edges of the brim, providing additional protection from sun or rain.

Another object of the invention is to provide an overlay which provides a surface which is superior to the cap brim for the reception of printed matter.

Another object of the invention is to provide an overlay which can be produced in a variety of colors letting the user easily alternate overlays based on aesthetic considerations.

Another object of the invention is to provide an overlay which has a reflective coating thereby providing greater visibility, especially at night.

Another object of the invention is to provide an overlay which has the user's name printed thereon, enabling the wearer to be readily identified by others.

BRIEF DESCRIPTION OF THE DRAWINGS

FIG. 7 shows a bottom view of an embodiment of the overlay.

FIG. 8 shows a top, plan view of the overlay being trimmed with scissors.

FIGS. 9 and 10 show a top, plan view of the overlay with a plurality of pictures and words.

DETAILED DESCRIPTION OF THE ILLUSTRATED EMBODIMENTS

Figure 1A:
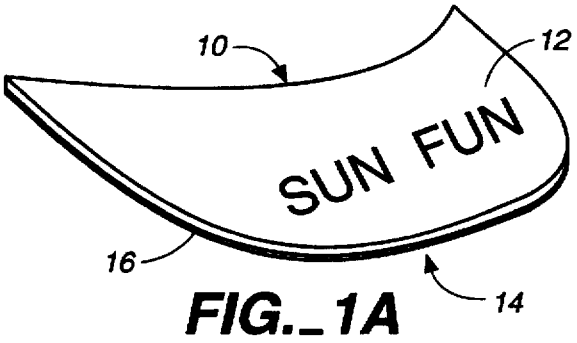
FIG. 1A is a perspective view of the overlay.
Figure 1B:
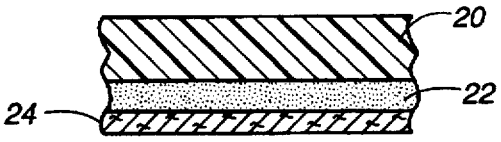
FIG. 1B is a diagrammatic view of a section of the overlay.
Figure 2:
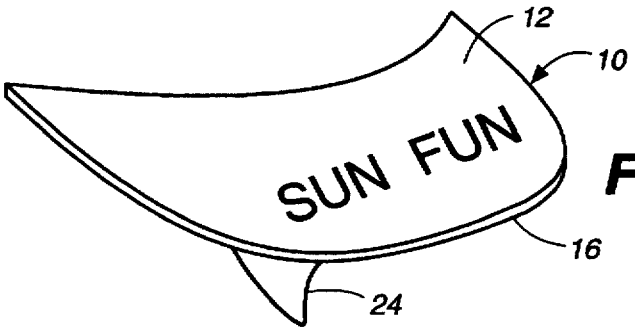
FIG. 2 is a perspective view of the overlay showing protective film being removed from the adhesive.

The preferred embodiment of the present invention is shown in FIGS. 1A, 1B and 2. An overlay 10 is formed in the shape of the brim of a conventional baseball cap, i.e. substantially crescent shaped. The overlay 10 has a flat upper surface 12 and a flat lower surface 14 with an edge 16 surrounding its periphery.

The overlay 10 consists of three layers of material, a base 20 formed in the shape of the overlay 10, a layer of adhesive 22 formed in the shape of the overlay 10 and affixed to all of the lower surface of the base 20, and protective film 24 formed in the shape of the overlay and affixed to the lower surface of the adhesive 22.

The base 20 is formed of a sheet material which is somewhat flexible so that it can conform to the cap brim when applied and is substantially impermeable to water and dirt. In the preferred embodiment the base is made of plastic. However, the base can also consist of other materials which are flexible and substantially impermeable such as vinyl, rubber, polyethylene, laminated fibrous materials, various plasticized materials, etc.

In the preferred embodiment the adhesive 22 is 3M 950 manufactured by the 3M company in the form of sheets, which I have found to have appropriate characteristics. Those characteristics include the ability to securely adhere to the base 20 while being able to temporarily adhere to and be removed from the cloth of a baseball cap without damage to the cloth. Another important characteristic of the adhesive 22 is the ability to remain securely adhered to the base 20 when the overlay 10 is peeled from the cap brim. Another important characteristic is to be substantially unaffected by water. Other adhesives besides 3M 950 can be used provided that they have the appropriate characteristics.

The protective film 24 is formed of a sheet material sold by the 3M company attached to its 3M 950 adhesive. The protective film adheres to the adhesive 22 and can easily be peeled therefrom and re-affixed thereto.

Figure 3:
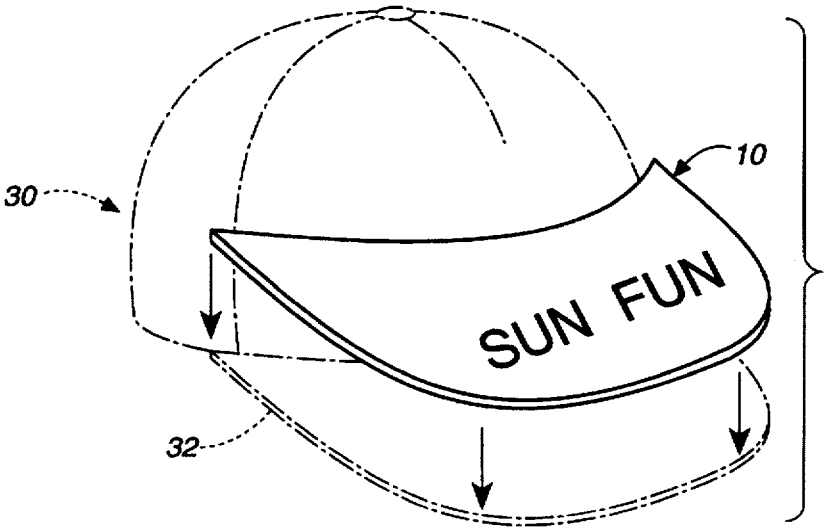
FIG. 3 shows the overlay being applied to a cap brim.
Figure 4:
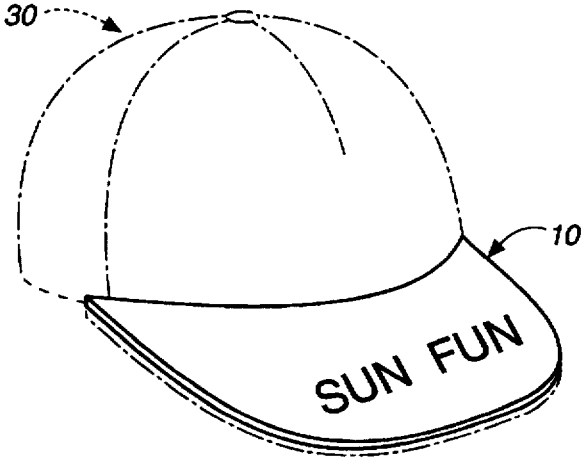
FIG. 4 shows the overlay attached to a cap brim.
Figure 5B:
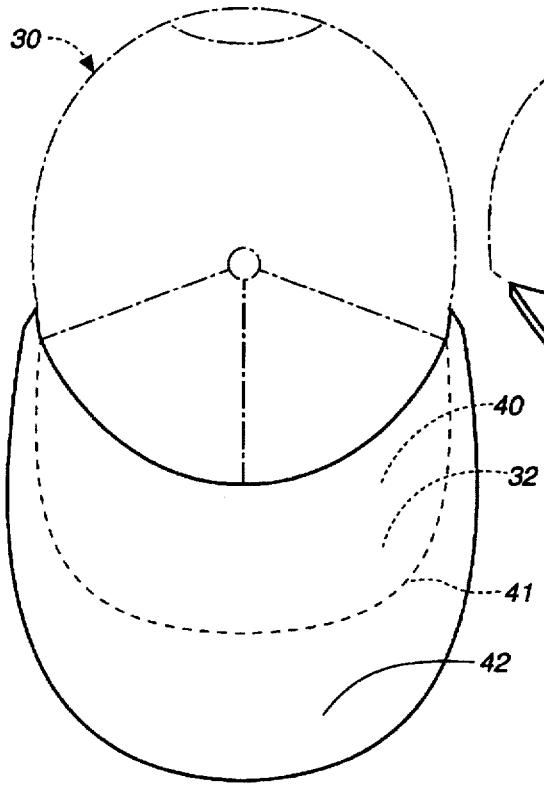
FIG. 5B shows a top, plan view of the overlay which extends beyond the cap bill.
Figure 5A:
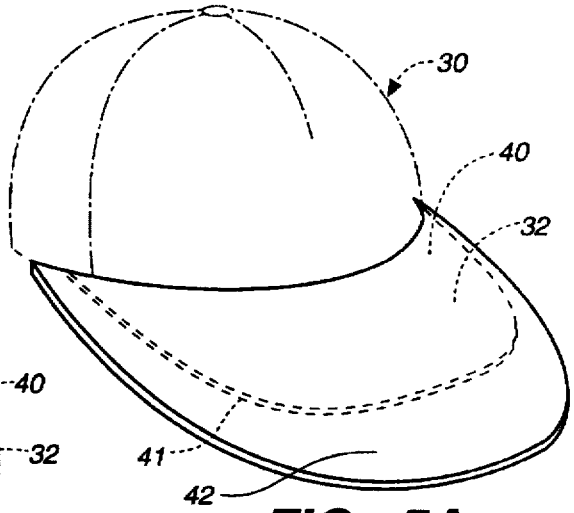
FIG. 5A shows a perspective view of the overlay which extends beyond the cap brim.

In operation the overlay 10 is used as follows, as shown in FIGS. 3 and 4. When initially sold to the user, the protective film 24 is affixed to the adhesive 22. When the user is ready to apply the overlay 10 to a cap 30, he or she removes the protective film 22 by peeling it off the adhesive 24. The user then aligns the overlay with the cap brim 32 and presses the adhesive 22 onto the brim.

If the user decides to remove the overlay 10 from the cap brim 32, the user peels the overlay 10 from the brim 32. The adhesive 22 remains firmly attached to the base 20 and is disengaged from the cloth of the brim 32 without damage thereto. The user can then attach the overlay 10 to another cap 30 or reapply the protective film 24 to the adhesive 22 so that the overlay can be stored without dirt adhering to the adhesive 22.

Another embodiment of the invention is shown in 5A and 5B. In this embodiment the overlay 10 is larger than the cap bill 32. In this embodiment the adhesive 22 is only affixed to a portion of the lower surface 14 of the base 20. The portion of the lower surface 14 of the base 20 which is covered by adhesive defines an area 40, the edge of which is shown by dotted line 41. Area 40 is substantially the same shape as the cap bill 32. The remaining portion of the lower surface 14 of the base 20 is not covered by adhesive 22 and defines an area 42. Thus, area 42 extends beyond the cap brim and has no adhesive to collect dirt.

Figure 6:
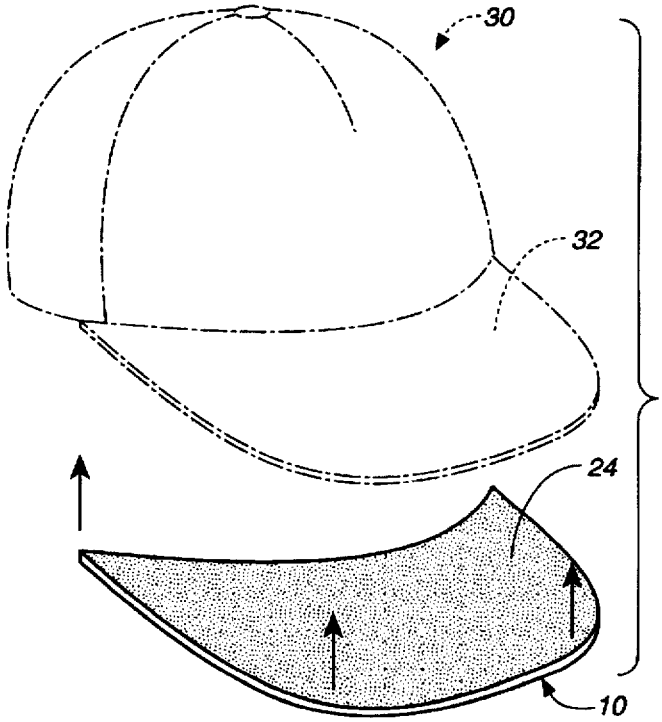
FIG. 6 shows the overlay installed on the underside of a cap brim.

Turning now to the embodiment shown in FIG. 6, there is shown the covering 10 oriented to be applied to the lower surface of the brim 32. In this embodiment, the covering 10 is oriented so that the adhesive 22 is on the upper surface of the covering 10.

In FIG. 7 there is shown another embodiment in which the overlay 10 is larger than the cap brim. In this embodiment, adhesive 22 is applied to the complete surface of the base 20, and there are perforations 50 formed in the film 24, the perforations 50 extending in a plurality of curved rows 52 from one side 54 of the overlay 10 to the other side 56. The rows 52 of perforations are formed so as to define a plurality of areas 58 between them. The areas 58 are shaped and sized to correspond to the shapes and sizes of standard cap brims. Thus, depending on the size and shape of the cap brim 32 that the user has, the user can remove one or more of the areas 58 of film 24 to thereby expose an area of adhesive 22 having substantially the same size and shape as the cap brim 32, while leaving film covering the remainder of the adhesive 22. Accordingly, when the user applies the covering to the cap brim 32, the part of the covering that extends beyond the brim has film 24 covering the adhesive so that dirt will not adhere thereto.

As shown in FIG. 8, the interior curvature of the overlay 10 can be trimmed, e.g. along line 60, with ordinary household scissors thus enabling the user to adapt the overlay to a variety of cap bills having different shapes. Similarly, the portion of an overlay that extends beyond a cap brim 32 can be trimmed, e.g. along line 62, to achieve the desired degree of extension.

In FIGS. 9 and 10 there are shown embodiments wherein pictorial displays, words and a plurality and combination thereof are painted on the overlay 10. For example, the names and numbers of professional athletes as well as various popular slogans can be used. Similarly reflective paint, not shown, can be applied to the overlay to provide for safety at night.

Although the description above contains many specificities, these should not be construed as limiting the scope of the invention but as merely providing illustrations of some of the presently preferred embodiments of the invention.

It should be recognized that although a cap with a brim has been described in the embodiments above, the invention can also be used with a conventional sun visor. Accordingly, the words visor or sun visor should be understood to be included within the words brim or cap brim. Also, the words cap brim and bill are also used interchangeably with one another.

I claim:

1. An overlay which can be attached to and detached from the brim of a cap, the overlay comprising:

(a) a base, made of flexible material and having a substantially crescent shape with two flat surfaces and an edge extending around the periphery thereof;

(b) adhesive material affixed to one of the two flat surfaces of the base; and, (c) removable film attached to the adhesive material.

2. The overlay of claim 1 wherein the overlay is designed and constructed to be larger than the brim of a standard cap brim to provide additional shade to the wearer of the cap beyond that provided by the brim.

3. The overlay of claim 1 wherein the base and the adhesive are designed and constructed so that the overlay can be repeatedly attached to and removed from the brim.

4. The overlay of claim 3 wherein the adhesive material and the removable film are designed and constructed so that when the overlay is removed from the brim the film can be re-attached to the adhesive to prevent dirt from adhering thereto.

5. The overlay of claim 1 wherein the base is constructed of a material which is impervious to water thereby to protect the brim from rain.

6. The overlay of claim 1 wherein the base is constructed of a material which is resistant to soil.

7. The overlay of claim 1 wherein the adhesive material is designed and constructed so that it clings to the brim without achieving a permanent bond therewith, thereby allowing the overlay to be repeatedly attached to and removed from the brim without damage to the cap brim.

8. The overlay of claim 1 wherein the base is constructed of material which is trimmable with ordinary household scissors whereby a person may trim the overlay to fit a particular cap brim or visor.

9. The overlay of claim 1 wherein the base has imprinted thereon a plurality of pictorial displays, a plurality of words, or a combination thereof.

10. The overlay of claim 1 wherein one surface of the base is covered with a reflective coating of paint.

11. The overlay of claim 1 wherein the adhesive material is affixed to the entire side of one of the two flat surfaces of the base.

12. An overlay which can be attached to and detached from the brim of a cap, the overlay comprising:

(a) a base, made of flexible material and having a substantially crescent shape with two flat surfaces and an edge extending around the periphery thereof;

(b) adhesive material affixed to at least a portion of one of the two flat surfaces of the base;

(c) removable film affixed to the adhesive material and having perforations located so that a portion of the film can be removed while the remainder of the film is left attached to the adhesive material.

13. The overlay of claim 12 wherein the perforations are located in a plurality of rows so that each row of perforations separates one area of the film from an adjacent area of the film and a single area of the film can be removed from the adhesive material without removing the adjacent area of the film.

14. The overlay of claim 13 wherein:

(a) the rows of perforations are designed and constructed so that one or more areas of film can be removed thereby to expose one or more areas of adhesive material; and, (b) the areas of film are shaped and sized to correspond to different standard sizes of brims so that the areas of adhesive material which can be exposed correspond to different standard sizes of brims.

15. The overlay of claim 12 wherein the adhesive material is affixed to the entirety of one of the two flat surfaces of the base.

16. An overlay which can be attached to and detached from the brim of a cap, the overlay comprising:

(a) a base, made of flexible material and having a substantially crescent shape with two flat surfaces and an edge extending around the periphery thereof;

(b) adhesive material affixed to only a portion of one of the two flat surfaces of the base; and, (c) removable film attached to the adhesive material.

17. The overlay of claim 16 wherein:

(a) the portion of the surface of the base covered by the adhesive material defines a first area and the portion of the base not covered by the adhesive material defines a second area; and, (b) the first area is designed to correspond in shape and size to the shape and size of a standard brim.

18. The overlay of claim 17 wherein the second area is designed to extend beyond the brim of the cap to provide additional shade to the wearer of the cap beyond that provided by the brim.

* * * * *